US006578327B1

(12) United States Patent
Hackbarth et al.

(10) Patent No.: US 6,578,327 B1
(45) Date of Patent: Jun. 17, 2003

(54) ATTIC SCUTTLE

(76) Inventors: Douglas Hackbarth, N. 7837 Sales Rd., Van Dyne, WI (US) 54979; Lori Hackbarth, N. 7837 Sales Rd., Van Dyne, WI (US) 54979

( * ) Notice: Subject to any disclaimer, the term of this patent is extended or adjusted under 35 U.S.C. 154(b) by 28 days.

(21) Appl. No.: 09/871,849

(22) Filed: Jun. 1, 2001

(51) Int. Cl.[7] ..... E06B 3/26

(52) U.S. Cl. ..... 52/202; 49/503; 49/394; 52/19; 52/39; 292/336.3; 182/70; 182/76; 182/129; 182/230

(58) Field of Search ..... 49/503, 394; 52/19, 52/39; 292/DIG. 31, 336.3; 182/70, 76, 129, 230

(56) References Cited

U.S. PATENT DOCUMENTS 2,100,124 A * 11/1937 Gilpin ..... 105/377.01
3,807,528 A * 4/1974 Frank ..... 182/81
4,299,059 A 11/1981 Smith
4,563,845 A 1/1986 Stipe
4,706,478 A * 11/1987 Swan et al. ..... 292/336.3
4,738,054 A 4/1988 Muth et al.
4,829,725 A * 5/1989 Gustaveson et al. ..... 312/7.2
4,832,153 A * 5/1989 Daw et al. ..... 182/46
4,916,862 A * 4/1990 Storer ..... 49/386
D335,982 S 6/1993 Brandon
5,220,757 A * 6/1993 Hulligan ..... 182/47
6,014,841 A 1/2000 Mccoy et al.

* cited by examiner

*Primary Examiner*—Carl D. Friedman
*Assistant Examiner*—Steve M Varner

(57) ABSTRACT

An attic scuttle for providing a means of accessing the attic which is easily installed, fire-rated, and forms a tight, insulating seal. The attic scuttle includes a sleeve with a perimeter wall, and a hinged door positioned within the base portion of the sleeve for facilitating access to the attic from a room below.

13 Claims, 2 Drawing Sheets

ATTIC SCUTTLE

BACKGROUND OF THE INVENTION

1. Field of the Invention

The present invention relates to attic hatchways and more particularly pertains to a new attic scuttle for providing a means of accessing the attic which is installed with ease, is fire-rated, and forms a tight, insulating seal.

2. Description of the Prior Art

The use of attic hatchways is known in the prior art. More specifically, attic hatchways heretofore devised and utilized arc known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,299,059; U.S. Pat. No. 4,563,845; U.S. Pat. No. 4,916,862; U.S. Pat. No. 6,014,841; U.S. Pat. No. 4,738,054; and U.S. Pat. No. Des. 335,982.

While these devices fulfill their respective, particular objectives and requirements, the aforementioned patents do not disclose a new attic scuttle. The inventive device includes a sleeve with a perimeter wall, and a hinged door positioned within the base portion of the sleeve for facilitating access to the attic from a room below.

In these respects, the attic scuttle according to the present invention substantially departs from the conventional concepts and designs of the prior art, and in so doing provides an apparatus primarily developed for the purpose of providing a means of accessing the attic which is installed with ease, is fire-rated, and forms a tight, insulating seal.

SUMMARY OF THE INVENTION

In view of the foregoing disadvantages inherent in the known types of attic hatchways now present in the prior art, the present invention provides a new attic scuttle construction wherein the same can be utilized for providing a means of accessing the attic which is installed with ease, is fire-rated, and forms a tight, insulating seal.

The general purpose of the present invention, which will be described subsequently in greater detail, is to provide a new attic scuttle apparatus and method which has many of the advantages of the attic hatchways mentioned heretofore and many novel features that result in a new attic scuttle which is not anticipated, rendered obvious, suggested, or even implied by any of the prior art attic hatchways, either alone or in any combination thereof.

To attain this, the present invention generally comprises a sleeve with a perimeter wall, and a hinged door positioned within the base portion of the sleeve for facilitating access to the attic from a room below.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new attic scuttle apparatus and method which has many of the advantages of the attic hatchways mentioned heretofore and many novel features that result in a new attic scuttle which is not anticipated, rendered obvious, suggested, or even implied by any of the prior art attic hatchways, either alone or in any combination thereof.

It is another object of the present invention to provide a new attic scuttle which may be easily and efficiently manufactured and marketed.

It is a further object of the present invention to provide a new attic scuttle which is of a durable and reliable construction.

An even further object of the present invention is to provide a new attic scuttle which is susceptible of a low cost of manufacture with regard to both materials and labor, and which accordingly is then susceptible of low prices of sale to the consuming public, thereby making such attic scuttle economically available to the buying public.

Still yet another object of the present invention is to provide a new attic scuttle which provides in the apparatuses and methods of the prior art some of the advantages thereof, while simultaneously overcoming some of the disadvantages normally associated therewith.

Still another object of the present invention is to provide a new attic scuttle for providing a means of accessing the attic which is installed with ease, is fire-rated, and forms a tight, insulating seal.

Yet another object of the present invention is to provide a new attic scuttle which includes a sleeve with a perimeter wall, and a hinged door positioned within the base portion of the sleeve for facilitating access to the attic from a room below.

Still yet another object of the present invention is to provide a new attic scuttle that is prefabricated, making it simple to install.

Even still another object of the present invention is to provide a new attic scuttle with a latching, fire-rated door for safety, and insulated thereby inhibiting thermal exchange between the attic and the room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
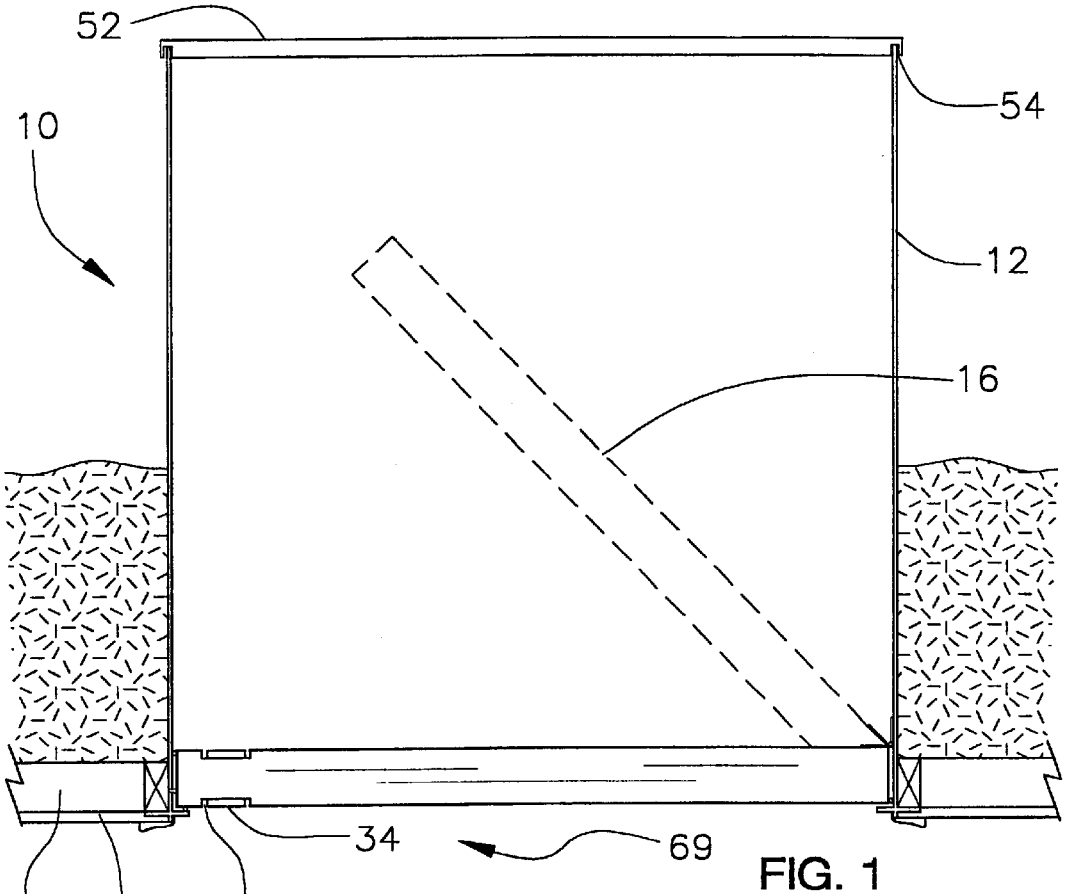
FIG. 1 is a schematic cross-sectional side view of a new attic scuttle according to the present invention.
Figure 2:
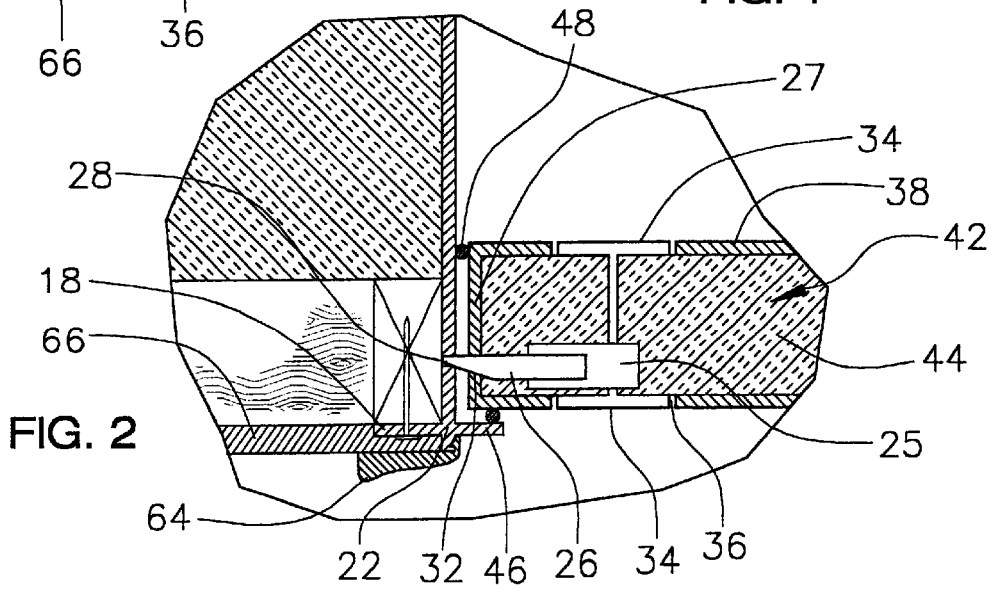
FIG. 2 is a schematic cross-sectional side view of the latching portion of the door of the present invention.
Figure 3:
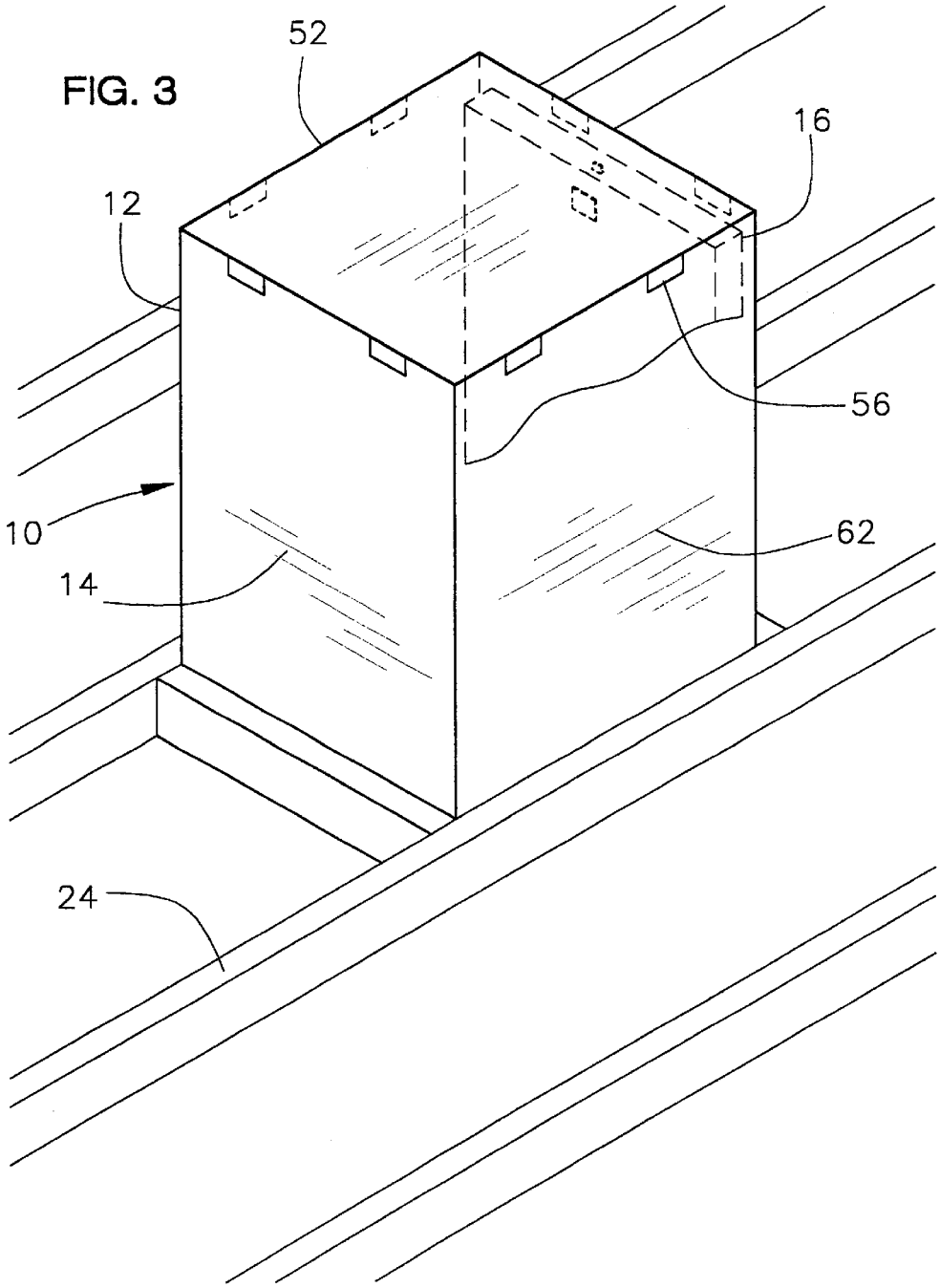
FIG. 3 is a schematic perspective view of the present invention.

With reference now to the drawings, and in particular to FIGS. 1 through 3 thereof, a new attic scuttle embodying the principles and concepts of the present invention and generally designated by the reference numeral 10 will be described.

As best illustrated in FIGS. 1 through 3, the attic scuttle 10 generally comprises a sleeve 12 that includes a perimeter wall 14 which is designed for facilitating access to the attic 68 from a room 69 below.

A door 16 is positioned within the sleeve 12. The door 16 is designed for selectively restricting access to the attic 68. The door 16 is hingably coupled to the perimeter wall 14 of the sleeve 12 for facilitating movement of the door 16 between a closed portion and an open position.

The sleeve 12 includes a flange 18 that extends outward from a bottom end 22 of the perimeter wall 14 of the sleeve 12. The flange 18 is designed for coupling to the joists 24 of the building for securing the sleeve 12 to the joists 24.

The door 16 includes a latch assembly 25. The latch assembly 25 is positioned proximate a peripheral wall 27 of the door 16. The latch assembly 25 is for selectively securing the door 16 to the sleeve 12.

The latching assembly includes a catch member 26 for selectively engaging an aperture 28 in the peripheral wall 27 of the sleeve 12. The catch member 26 inhibits opening of the door 16 when the catch member 26 engages the aperture 28.

The catch member 26 includes an angled face 32 for facilitating retraction of the catch member 26 into the door 16 when the door 16 is closed.

A plurality of handles 34 is operationally coupled to the latching assembly. Each of the handles 34 is rotatable for selectively retracting the catch member 26 from the aperture 28 for permitting the door 16 to be opened when one of the handles 34 is rotated.

The door 16 includes a plurality of recesses 36 with each of the respective handles 34 positioned within such that each of the handles 34 is positioned flush with an exterior surface 38 of the door 16 for preventing the handles 34 from being caught on an object when the door 16 is opened and closed.

The peripheral wall 27 of the door 16 defines an interior space 42. An insulating material 44 is positioned within the interior space 42 of the door 16. The insulating material 44 is designed for inhibiting thermal exchange from the attic 68 to the room 69.

The sleeve 12 includes a lip 46 that extends inward from the bottom end 22 of the perimeter wall 14. The lip 46 is designed for supporting the door 16 when the door 16 is in a closed position.

A plurality of sealing members 48 each is coupled to one of the sleeve 12 and the door 16. Each of the sealing members 48 is positionable between the sleeve 12 such that they are designed for inhibiting environmental communication between the attic 68 and the room 69 when the door 16 is in the closed position.

A lid member 52 is for selectively coupling to a top end 54 of the sleeve 12. The lid member 52 is designed for inhibiting environmental communication between the attic 68 and the room 69 when the lid is coupled to the top end 54 of the sleeve 12. A plurality of tabs 56 extend downward from a perimeter edge 58 of the lid member 52. Each of the tabs 56 is for abutting against an outer surface 62 of the sleeve 12. The tabs 56 prevent the lid member 52 from inadvertently sliding off of the top end 54 of the sleeve 12.

At least one trimming member 64 is for coupling to the bottom end 22 of the sleeve 12. The trimming member 64 is designed for aesthetically concealing the transition between the sleeve 12 and the joist and wall boarding 66 of the room 69.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An attic scuttle for permitting access to the attic of a building, the attic scuttle comprising:

a sleeve having a perimeter wall, said sleeve being adapted for coupling to joists forming a floor of the attic, said sleeve being adapted for facilitating access to the attic from a room below;

a door being positioned within said sleeve, said door being selectively closable such that said door is adapted for selectively restricting access to the attic by a user when said door is closed, said door being hingably coupled to said perimeter wall of said sleeve for facilitating movement of said door between a closed position and an open position;

a lid member being for selectively coupling to a top end of said sleeve, said lid member being adapted for inhibiting environmental communication between the attic and the room when said lid is coupled to the top end of the sleeve; and a plurality of tabs downwardly extending from a perimeter edge of said lid member, each of said tabs being for abutting against an outer surface of said sleeve such that said tabs prevent said lid member from inadvertently sliding off of said top end of said sleeve when said lid member is coupled to said sleeve.

2. The attic scuttle as set forth in claim 1, further comprising:

said sleeve having a flange, said flange extending outwardly from a bottom end of said perimeter wall of said sleeve, said flange being adapted for coupling to the joists of the building for securing said sleeve to the joists.

3. The attic scuttle as set forth in claim 1, further comprising:

said door having a latch assembly, said latch assembly being positioned proximate a peripheral wall of said door, said latch assembly being for selectively engaging said perimeter wall of said sleeve such that said latch assembly is for selectively securing said door to said sleeve.

4. The attic scuttle as set forth in claim 3, further comprising:

said latching assembly having a catch member being selectively extending from said peripheral wall of said door, said catch member being for selectively engaging an aperture in said peripheral wall of said sleeve such that said catch member inhibits opening of said door when said catch member engages said aperture.

5. The attic scuttle as set forth in claim 4, further comprising:

said catch member having an angled face, said angled face being for facilitating retraction of the said catch member into said door when said door is being closed.

6. The attic scuttle as set forth in claim 4, further comprising:

a plurality of handles being operationally coupled to said latching assembly, each of said handles being rotatable such that each of said handles are for selectively retracting said catch member from said aperture for permitting said door to be opened when one of said handles is rotated.

7. The attic scuttle as set forth in claim 6, further comprising:

said door having a plurality of recesses, each of said handles being positioned within one each of said recesses such that each of said handles is positioned flush with an exterior surface of said door for preventing said handles from being caught on an object when said door is being opened and closed.

8. The attic scuttle as set forth in claim 1, further comprising:

said door having a peripheral wall defining an interior space, an insulating material being positioned within said interior space of said door, said insulating material being adapted for inhibiting thermal exchange from the attic to the room.

9. The attic scuttle as set forth in claim 1, further comprising:

a plurality of sealing members each being coupled to one of said sleeve and said door, each of said sealing members being positionable between said sleeve such that each of said sealing members is adapted for inhibiting environmental communication between the attic and the room when said door is in said closed position.

10. The attic scuttle as set forth in claim 1, further comprising:

at least one trimming member being for coupling to a bottom end of said sleeve, said trimming member being adapted for aesthetically concealing the transition between said sleeve and the joist and wall boarding of the room.

11. An attic scuttle for permitting access to the attic of a building, the attic scuttle comprising:

a sleeve having a perimeter wall, said sleeve being adapted for coupling to joists forming a floor of the attic, said sleeve being adapted for facilitating access to the attic from a room below;

a door being positioned within said sleeve, said door being for selectively closing such that said door is adapted for selectively restricting access to the attic by a user when said door is closed, said door being hingably coupled to said perimeter wall of said sleeve for facilitating movement of said door between a closed position and an open position;

said sleeve having a flange, said flange extending outwardly from a bottom end of said perimeter wall of said sleeve, said flange being adapted for coupling to the joists of the building for securing said sleeve to the joists;

said door having a latch assembly, said latch assembly being positioned proximate a peripheral wall of said door, said latch assembly being for selectively engaging said perimeter wall of said sleeve such that said latch assembly is for selectively securing said door to said sleeve;

said latching assembly having a catch member being selectively extending from said peripheral wall of said door, said catch member being for selectively engaging an aperture in said peripheral wall of said sleeve such that said catch member inhibits opening of said door when said catch member engages said aperture;

said latch member having an angled face, said angled face being for facilitating retraction of the said latch member into said door when said door is being closed;

a plurality of handles being operationally coupled to said latching assembly, each of said handles being rotatable such that each of said handles are for selectively retracting said catch member from said aperture for permitting said door to be opened when one of said handles is rotated;

said door having a plurality of recesses, each of said handles being positioned within one each of said recesses such that each of said handles is positioned flush with an exterior surface of said door for preventing said handles from being caught on an object when said door is being opened and closed;

said peripheral wall defining an interior space, an insulating material being positioned within said interior space of said door, said insulating material being adapted for inhibiting thermal exchange from the attic to the room;

said sleeve having a lip, said lip inwardly extending from said bottom end of said perimeter wall, said lip being adapted for supporting said door when said door is in a closed position;

a plurality of sealing members each being coupled to one of said sleeve and said door, each of said sealing members being positionable between said sleeve such that each of said sealing members is adapted for inhibiting environmental communication between the attic and the room when said door is in said closed position;

a lid member being for selectively coupling to a top end of said sleeve, said lid member being adapted for inhibiting environmental communication between the attic and the room when said lid is coupled to the top end of the sleeve;

a plurality of tabs downwardly extending from a perimeter edge of said lid member, each of said tabs being for abutting against an outer surface of said sleeve such that said tabs prevent said lid member from inadvertently sliding off of said top end of said sleeve when said lid member is coupled to said sleeve;

at least one trimming member being for coupling to said bottom end of said sleeve, said trimming member being adapted for aesthetically concealing the transition between said sleeve and the joist and wall boarding of the room.

12. An attic scuttle for permitting access to the attic of a building, the attic scuttle comprising:

a sleeve for coupling to joists forming a floor of the attic to facilitate access to the attic from a room below, said sleeve having a perimeter wall;

a door being positioned in said sleeve, said door being pivotally coupled to said perimeter wall of said sleeve and being pivotable between an open position and a closed position;

a lid member being for selectively coupling to a top end of said sleeve, said lid member being adapted for inhibiting environmental communication between the attic and the room when said lid is coupled to the top end of the sleeve; and a plurality of tabs downwardly extending from a perimeter edge of said lid member, each of said tabs being for abutting against an outer surface of said sleeve such that said tabs prevent said lid member from inadvertently sliding off of said top end of said sleeve when said lid member is coupled to said sleeve.

13. The attic scuttle as set forth in claim 1, further comprising:

said sleeve having a lip, said lip extending inwardly from a bottom end of said perimeter wall, said lip being adapted for supporting said door when said door is in a closed position.

* * * * *